United States Patent [19]

Meshberg

[11] Patent Number: 4,867,352

[45] Date of Patent: Sep. 19, 1989

[54] DISPENSING VALVE ASSEMBLY FOR USE WITH A PRESSURIZED CONTAINER

[76] Inventor: Philip Meshberg, 2500 S. Ocean Blvd., Palm Beach, Fla. 33480

[21] Appl. No.: 177,606

[22] Filed: Apr. 5, 1988

[51] Int. Cl.[4] ..... B65D 83/14

[52] U.S. Cl. ..... 222/402.16; 222/402.2

[58] Field of Search ..... 222/402.1, 402.16, 402.18, 222/402.2, 402.24; 141/3; 137/353, 354

[56] References Cited

U.S. PATENT DOCUMENTS

| | | | |
|---|---|---|---|
| 3,185,356 | 5/1965 | Venus, Jr. | 222/402.16 X |
| 3,394,851 | 7/1968 | Gorman | 222/402.2 |
| 3,862,741 | 1/1975 | Steiman et al. | 222/402.24 |
| 4,271,875 | 6/1981 | Meshberg | 141/3 |
| 4,702,400 | 10/1987 | Corbett | 222/402.2 |
| 4,744,495 | 5/1988 | Warby | 222/402.16 |

FOREIGN PATENT DOCUMENTS

| | | | |
|---|---|---|---|
| 125865 | 11/1984 | European Pat. Off. | 222/402.16 |
| 864694 | 4/1961 | United Kingdom | 222/402.2 |
| 1287126 | 8/1972 | United Kingdom . | |

*Primary Examiner*—Michael S. Huppert
*Attorney, Agent, or Firm*—Kenyon & Kenyon

[57] ABSTRACT

An improved drainage tank assembly for a metered dispenser which includes a metering tank secured within a mounting cup, the mounting cup adapted to be secured to a container. The drainage tank includes a sealing portion which seals the interior of drainage tank from the mounting cup to prevent both corrosion of the mounting cup and contamination of the product dispensed. The drainage tank further includes radially extending ribs which extend from an interior surface of the drainage tank toward an outside surface of the metering tank to limit axial displacement of a band seal mounted on the outside surface of the metering tank.

19 Claims, 2 Drawing Sheets

DISPENSING VALVE ASSEMBLY FOR USE WITH A PRESSURIZED CONTAINER

BACKGROUND OF THE INVENTION

This invention relates to pressurized dispensers in general and more particularly to a valve assembly for use with a pressurized container. The valve assembly of this invention allows pressure filling of a container with propellant after the assembly has been engaged with the container and prevents contamination of the material to be dispensed and corrosion of the valve assembly housing.

Generally, pressurized containers comprise a can or bottle containing the material to be dispensed (hereinafter "product") along with a pressurizing fluid, either a valve or a pump, and a mounting cup by means of which the valve or pump is mounted on top of the can or bottle. Generally, in a valve type arrangement, the pressurizing fluid is a liquid propellant, whereas in a pump type arrangement, nitrogen or compressed gas is used. Typically, in a valve type arrangement, a valve for dispensing the product may be crimped into the mounting cup with a diaphragm disposed between the top of the valve body and the mounting cup for sealing around the valve stem and the top of the valve body.

In general, two types of aerosol valves are in common use. They are a metering valve and a non-metering valve. The construction of the metering valve is such that a chamber is formed in the valve body. The chamber is of a size to hold a metered dose of the product to be dispensed. When the valve is in an unoperated position, the tank formed in the valve body is placed in communication with a dip tube extending to the bottom of the can and the tank is filled with the product to be dispensed under pressure. Upon the depression of the valve stem, the inlet from this dip tube and, thus from the container, is closed off and an outlet through the upper part of the stem is then opened. The material under pressure in the tank is forced out through the dispensing outlet. In a nonmetering valve, on the other hand, the tank is always in communication with the dip tube and thus with the container. As a result, depressing the valve to place the outlet in communication with the tank permits a continuous dispensing of the product.

Generally, there are two methods for getting propellant into the container to pressurize the product. One method is cold filling in which the propellant is maintained in its liquid state by cooling and is filled into the container in the liquid state. This, of course, requires special refrigeration equipment to maintain the container and the propellant at a low temperature until the mounting cup and the valve therein can be crimped in place on top of the container. Cold filling, in addition to being complex and expensive, is not at all practical in some cases and may even be dangerous, especially when using hydrocarbon propellants. A certain amount of propellant will escape and collect during cold filling thereby causing a potentially explosive danger when a hydrocarbon such as butane is used as propellant.

Another method of filling, to which this invention is more particularly directed, is known as press re filling. In this method of filling, which is disclosed in my prior U.S. Pat. No. 4,271,875, the propellant is forced into the container, generally through the dispensing outlet in the valve stem. The rate of dispensing from the valve is normally controlled by an orifice or outlet port in the stem. If pressure filling must take place through the orifice, it will take a long period of time. Thus, various methods of achieving fast pressure filling have been developed. For example, sealing ring or diaphragm may be disposed about the outlet port such as disclosed in British Pat. No. 1,287,126. In this arrangement for pressure filling, openings are located at the top edge of the valve body. Normally these holes are covered by the sealing ring or diaphragm at the top of the valve body by means of which the valve is sealed to the mounting cup. In this method of pressure filling, the propellant, after it reaches the tank, forces its way under the sealing ring and finds its way to the holes whereupon it reaches the container.

One known dispenser to which the present invention is particularly suited is adapted for fast pressure filling as discussed above and includes a valve assembly comprising a mounting cup which is adapted to be sealingly and fixingly secured to a container. The mounting cup further defines a central opening through which a discharge plunger may pass, the plunger having restricted axial movement relative to the mounting cup. The plunger has an upper portion which has an axially extending bore terminating in an outlet. The lower end of the axial bore communicates with a radially directed port which extends to the outer circumference of the upper plunger portion.

The plunger also has a lower portion joined to an inner end of the upper portion and extending within the mounting cup. The lower portion containing one or more slots along a portion of its length, beginning from the end of the lower plunger portion furthest away from the upper plunger portion.

The lower plunger portion extends into a metering tan which is in sealing contact with the mounting cup. The metering tank has an opening at its inner end with the inner end of the plunger extending through this opening and out of the metering tank. The metering tank includes at least one axial port extending through its walls which communicates with a space formed between the metering tank and the plunger. A fluid tight seal is formed over this port by an elastic, extendable rubber band-like seal member. The valve assembly further comprises a drainage tank having an open end placed over the metering tank and the lower plunger portion subassembly.

Containers such as those described above often contain parts which are formed from a metal, such as the valve assembly housing which may be formed from stainless steel and the mounting cup which maybe formed from aluminum. Due to the arrangement of the housing over the container filler opening, the housing will often be contacted by the product contained within the container. Since some of these products have a tendency to attack and or corrode the metal housing (e.g., medications which are acidic are known to corrode aluminum in the presence of moisture) the product contained in prior dispensers may become contaminated and the quality of the seal between the housing and the container may degrade.

It is therefore an object of the present invention to provide a valve assembly which prevents contamination of the product and is not subject to chemical attack by the product.

Another object of this invention to provide an improved pressure filling valve which will expand upon connection to a source of pressurized fluid thereby permitting propellant to flow into the container and pressurize the product, yet at the same time remain in its sealing location to ensure proper closing of the valve after pressure filling is completed and the source is disconnected.

These and other objects of the present invention will become apparent from the following description an claims in combination with the drawings.

SUMMARY OF THE INVENTION

The objects of the present invention are achieved through the provision of an unique drainage tank structure. More specifically, the drainage tank includes a plurality of ribs allowing the rubber band-like seal member to expand, yet at the same time preventing the seal member from moving from its sealing location by limiting axial displacement thereof. The drainage tank further includes a sealing portion comprising an annular flange which extends away from the tank portion of the drainage tank adjacent to the open end thereof such that the open end and flange of the drainage tank are in sealing contact within the mounting cup. Thus, the interior of the drainage tank is sealed from the mounting cup, thereby preventing both corrosion of the mounting cup and contamination of the product dispensed.

DETAILED DESCRIPTION OF THE DRAWINGS

Figures 1, 2, 3:
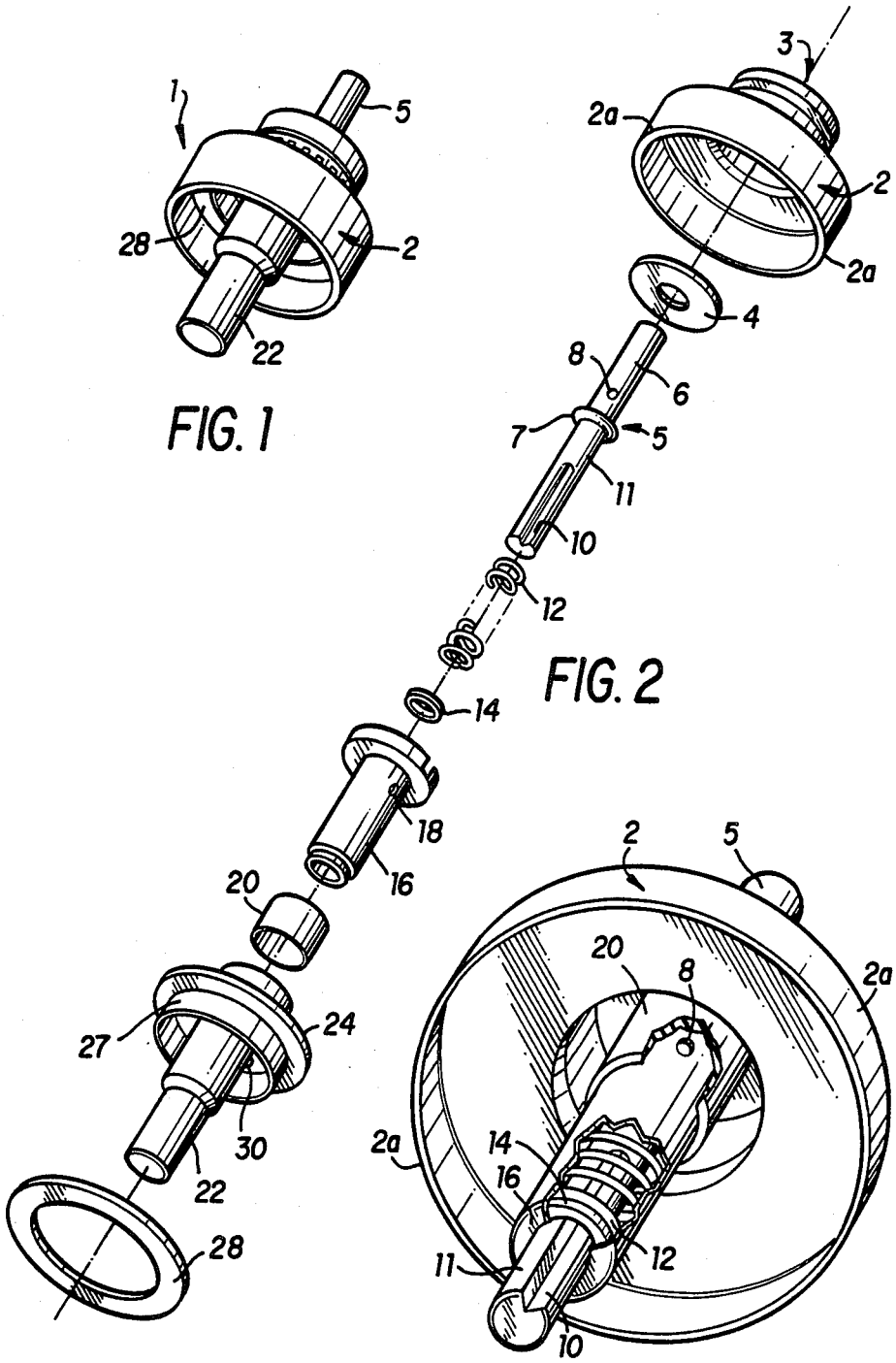
FIG. 1 is a perspective view of the valve assembly of the present invention.
FIG. 2 is an exploded perspective view of the assembly of FIG. 1.
FIG. 3 is a bottom partially broken away view of the assembly without the drainage tank.

Referring to the FIGS. 1 and 2, a valve assembly in accordance with the present invention is shown, generally referred to by reference numeral 1.

The valve assembly 1 includes a mounting cup 2 which is provided with an enlarged container engaging portion 2*a* which fits around and engages (usually by crimping) the opening provided in a suitable container (not shown) to form an air tight seal. The mounting cup 2 may be formed from any suitable metal which is capable of being crimped about the container opening with aluminum being preferred.

A central opening 3, provided through the mounting cup 2, loosely encircles a plastic plunger 5 which is passed therethrough, the plunger being slidingly sealed within opening 3 by a circular gasket 4 for limited axial motion.

Figure 6:
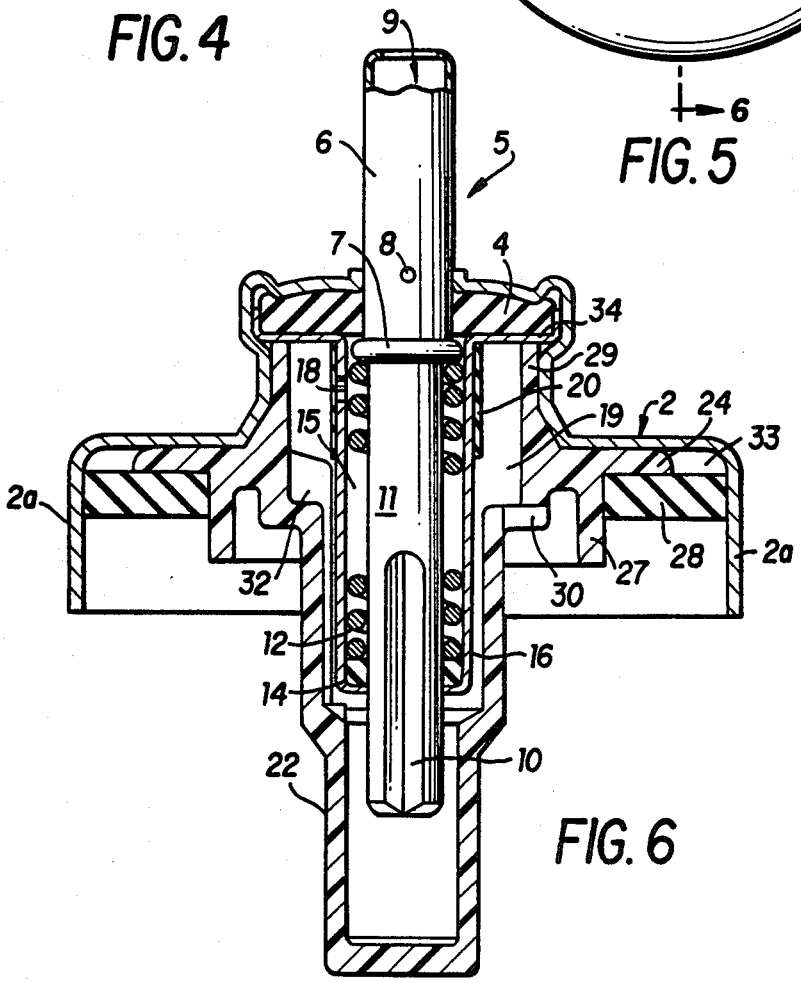
FIG. 6 is a cross-sectional view of the assembly of FIG. 1 taken along line 6—6 of FIG. 5.

As best shown in FIGS. 2 and 6, the plunger 5 comprises a rod-like structure having a lower portion 11 and an upper portion 6 which extends through the opening 3 in the mounting cup 2.

Figure 5:
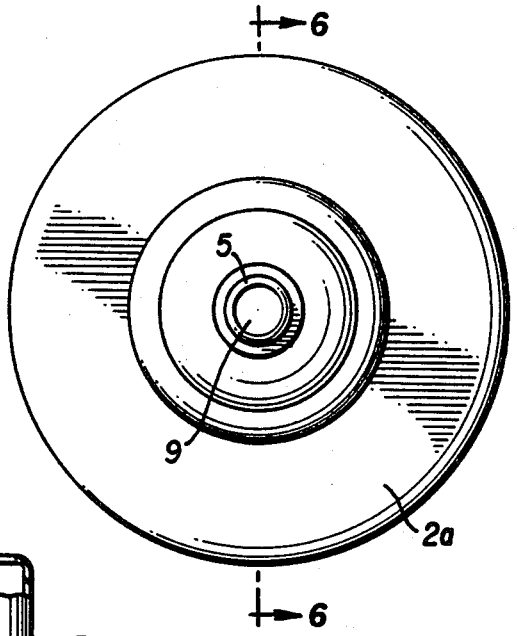
FIG. 5 is a top view of the assembly of FIG. 1.

As shown in FIGS. 5 and 6, the outer plunger portion 6 is provided with an axially extending outlet passage 9 which provides an outlet for product from the valve assembly 1. The inner end of outlet passage 9 communicates with a radially directed port 8.

As shown in FIGS. 2 and 6, the inner plunger portion 11 is provided with an annular flange 7 at its outer end. When the valve is operated the flange abuts against gasket 4 within the mounting cup 2 and acts as a stop to provide an upper limit to the axial movement of the plunger 5 as it slides within the valve assembly. The inner plunger portion 11 is further provided with a type of valving, in this case, at least one slot 10 extending in an axial direction along a portion of the surface of the inner plunger portion 11 to the free, inner end of the lower portion 11. This type of valving is also disclosed in my U.S. Pat. No. 4,271,875 and British Pat. No. 1,287,126 to Watts et al. Other possible valving includes those shown in my U.S. Pat. Nos. 4,311,255; 4,456,153; 3,637,114 and 3,920,158.

A metering tank 16 surrounds the inner plunger portion 11. The metering tank is preferably constructed of a corrosion resistent material such as stainless steel. The top or outer end of the metering tank 16 is crimped within mounting cup 2 and gasket 4 ensures sealing between metering tank 16 and mounting cup 2. The bottom or inner end of metering tank 16 includes an opening through which the valve containing portion (in this case slot containing portion) of the inner plunger portion 11 passes. A sealing gasket 14 is provided within metering tank 16 adjacent to this opening to provide a slidable seal around the plunger 5. Disposed within the metering tank 16, around the plunger 5 is a spring 12. At one end, spring abuts flange 7 and at the opposite end it abuts gasket 14. In this way, plunger 5 is biased in an upward direction with flange 7 in abutting relationship with gasket 4 in mounting cup 2.

As shown in FIGS. 3 and 6, the metering tank 16 further includes a plurality of radially directed openings 18 which communicate with the space 15 formed between the metering tank 16 and lower plunger portion 11. A rubber band-like seal 20 is provided on the outside surface of the metering tank 16 resiliently covering the openings 18 to prevent fluid from passing into the metering tank via these openings 18. The seal 20 may be formed from any suitable inert, elastic material capable of expansion and contraction. Suitable materials include rubber and plastic.

Finally, as shown in FIG. 6, a drainage tank 22 is provided having an open end which nests within the mounting cup 2 and completely surrounds the metering tank 16 and the lower plunger portion 11 thereby forming a space 19 between the metering tank 16 and the drainage tank 22. The drainage tank is preferably constructed of a plastic material. The drainage tank 22 (also shown in FIG. 4) is further provided with an annular flange 24 which extends radially away from the drainage tank 22 adjacent the open end thereof and nests within the enlarged portion 2*a* of the mounting cup 2. Downwardly depending from flange 24 is an annular drainage tank portion 27 which along with flange 24 locates a sealing gasket 28 against enlarged portion 2*a* of the mounting cup. Gasket 28 and flange 24 form a seal between the lip of the container (not shown) and the mounting cup upon crimping (or similar operation) of the cup to the container. Additionally, the joining of the mounting cup to the container results in a press fitting of the drainage tank to the mounting cup.

In accordance with a first important aspect of the present invention, outwardly depending from flange 24 is a sealing portion 29 which at its uppermost end forms a seal against flange 34 of metering tank 16. This seal prevents any potentially corrosive product in space 19 from contacting metal mounting cup 2. Thus, the sealing portion 29 seals space 19 including the interior of the drainage tank from mounting cup 2 thereby preventing both contamination of the product dispensed and corrosion of the mounting cup 2.

A greater sealing area and thus enhanced sealing is produced upon connection of the container to the mounting cup as gasket 28 will be forced into space 33 located between flange 24, gasket 28 and mounting cup portion 2*a*. Although in the illustrated, preferred, embodiment gasket 28 is provided as a separate member, it may be integrally formed with the drainage tank 22.

The drainage tank 22 has at least one opening 30 which allows the product within the container to pass through the drainage tank space 19 into the reservoir formed by the drainage tank 22.

Figure 4:
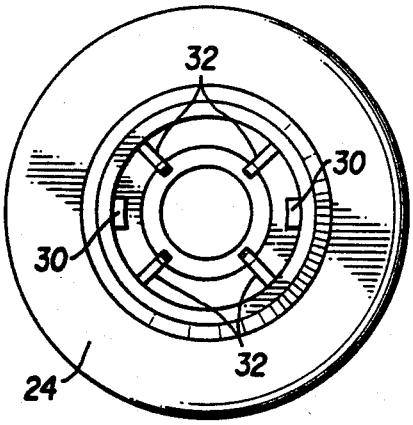
FIG. 4 is a top view of the drainage tank which forms a part of the assembly of FIG. 1.

In accordance with a second important aspect of the present invention, the drainage tank further includes a plurality of radially extending internal ribs or extensions 32, as shown in FIGS. 4 and 6, which limit axial displacement of the band seal 20 on metering tank 16 to a sufficient extent to ensure that the band seal does not slide away from openings 18,.during the pressure filling operation hereinafter described As is evident from FIGS. 4 and 6, each rib 32 has a radially innermost surface which is spaced from the outside surface of the metering tank 16 a distance which is less than the radial thickness of the band seal 20. Accordingly, the band seal 20 cannot freely pass between the ribs 32 and the metering tank 16. Further, as shown in FIG. 4, the ribs 32 are radially equispaced about the axes of the drainage tank and metering tank 16.

The metering tank 16, drainage tank 22 and plunger 5 are formed from any suitable non-corrosive metal or plastic material with a metal such as stainless steel being preferred for metering tank and plastic being preferred for the drainage tank and plunger. Gaskets 4, 14 and 28 may be formed from any suitable inert, non-toxic sealing material such as rubber or plastic.

The valve assembly 1 of the present invention is joined to a container (not shown) by inserting the drainage tank end of the assembly into an opening provided in the container such that the gasket 28 rests on the top of an annular extension which typically surrounds a container opening. The enlarged, engaging portion 2*a* of mounting cup 2 extends around the exterior of this extension and is then crimped, rolled or otherwise secured in an air tight manner therearound such that a leak proof seal is formed between the gasket 28 and the container.

In accordance with the present invention, pressure filling of the container may be undertaken after the valve assembly 1 has been secured to the container. This is accomplished by attaching a source of pressurized fluid to the upper plunger portion 6 and depressing the plunger 5 such that the slot 10 passes completely out of the metering tank 16 and the port 8 defined in the upper plunger portion 6 passes into the metering tank 16. The pressurized fluid may then pass from the fluid source through the axial bore 9 and into the metering tank 16 via port 8. When the metering tank 16 is filled with fluid, the fluid pressure will force seal 20 away from drainage tank openings 18 thereby allowing the fluid to pass into drainage tank 22 where it may then pass into the container on which the valve assembly is mounted via openings 30 provided in drainage tank 22. When the source of pressurized fluid is removed from the upper flange portion 6, the metering tank seal 20 returns to its original position over the openings 18 thereby preventing any backflow from the container. Internal ribs 32 prevent seal 20 from sliding down and thus away from openings 18 before the source of pressurized fluid is removed.

In the dispensing operation, the container (upon which valve assembly 1 of the present invention is mounted) is inverted. Pressurized product within the container passes through drainage tank openings 30 and completely fills the drainage tank 22. When the plunger 5 is in its unoperated position, the spring 12 biases plunger 5 out of the container such that flange 7 abuts gasket 4. With the plunger 5 in this position a portion of slot 10 extends into the metering tank 16 allowing the product in the drainage tank 22 to pass into and completely fill the metering tank 16.

When the plunger 5 is operated (i.e., depressed against the force of the spring 12) the slot 10 passes out of the metering tank 16 and no more fluid may pass therein. Simultaneously or soon thereafter upon continued depression of the plunger, the port 8 in the upper plunger portion 6 passes past gasket 4 into the metering tank 16, thereby allowing the pressurized product contained within the metering tank to pass through the upper stem portion 6 via axial bore 9.

Since the metering tank 16 and the components therein are of a predetermined size and since no additional product may pass into space 15 of the metering tank after the plunger 5 is operated, the amount of discharge or dosage is known and the dispensing process may be repeated over and over again with substantially the same dosage being dispensed each time. Thus, a metered dosage may be provided based upon the predetermined volume of space 15. The discharge of a reliably metered dosage is particularly important when the product dispensed is intended for internal consumption such as, for example, medicine.

Drainage tank 22 functions to keep metering tank 16 completely immersed in the pressurized product despite repeated inversion and use of the container. Thus, the metering tank will always have available to it a sufficient amount of pressurized product to fill space 15 thereby ensuring that the predetermined dosage will be dispensed upon each operation of the plunger until the container is emptied.

The upper plunger portion 6 of the valve assembly 1 of the present invention is typically provided with some type of nozzle actuator (not shown) which may be useful in controlling the direction and shape of the dispensed stream of fluid. In addition, it will be clear to one skilled in the art that the valve assembly 1 of the present invention may be used to dispense many different pressurized fluid products such as medicines, perfumes, and the like. Further, because the drainage tank 22 includes a sealing portion 29 which prevents contamination of the product dispensed and corrosion of the mounting cup 2, the valve assembly is particularly advantageous for dispensing products, such as medicines, where any contamination and/or corrosion is extremely undesirable.

What is claimed is:

1. An improved dispensing valve assembly for use with a pressurized container, said valve assembly comprising;

a mounting cup adapted to be secured to a container;

a metering tank secured within said mounting cup, said metering tank having an outer end, an inner end, an interior surface, an outside surface and at least one radially directed opening proximate said outer end, said opening extending between the interior surface and the outside surfaces to communicate the interior of the metering tank with the exterior of the metering tank;

a band seal surrounding an upper portion of said outside surface of the metering tank and resiliently covering the radially directed opening; and a drainage tank including an interior surface surrounding a lower portion of said outside surface of the metering tank and radially spaced therefrom, an exterior surface and at least one radially inwardly extending internal rib extending radially inward of said drainage tank interior surface, said interval rib having a radially innermost surface which is radially spaced from the outside surface of the metering tank, the axial extent of said rib toward said outer end being such as to limit axial displacement of said band seal such that said band seal remains over said radially directed openings.

2. The dispensing valve assembly of claim 1 wherein a plurality of radially spaced internal ribs extend radially inward of said drainage tank interior surface.

3. The dispensing valve assembly of claim 1 wherein said at least one internal rib includes a radially innermost surface which is spaced from the outside surface of the metering tank a distance which is less than the radial thickness of the band seal such that the band seal is unable to pass between the radially innermost surface of the internal rib and the outside surface of the metering tank.

4. The dispensing valve assembly of claim 2 wherein each one of said plurality of radially spaced internal ribs includes a radially innermost surface which is spaced from the outside surface of the metering tank a distance which is less than the radial thickness of the band seal such that the band seal is unable to pass between the internal ribs and the outside surface of the metering tank.

5. The dispensing valve assembly of claim 1, said drainage tank further comprising a sealing structure abutting the metering tank between the outer end of said metering tank and the at least one opening so as to provide a seal between the interior of the drainage tank and the mounting cup.

6. The dispensing valve assembly of claim 5 wherein said sealing structure comprises an axially extending portion spaced radially from said at least one opening and sealingly abutting said radially extending flange of said metering tank.

7. The dispensing valve assembly of claim 1, said drainage tank further comprising an annular flange extending radially outward of said exterior surface, said annular flange including an outer surface in annular contact with said mounting cup and an inner surface.

8. The dispensing valve assembly of claim 7, further comprising an annular gasket, said annular gasket being disposed around said drainage tank in annular contact with said inner surface of said drainage tank annular flange, said annular gasket and said drainage tank annular flange together forming a seal between the interior of the container and the mounting cup when the mounting cup is joined to the container.

9. The dispensing valve assembly of claim 1, in which all parts of said valve assembly which are subject to contact with products contained in said container are constructed of corrosion resistant materials.

10. The valve assembly of claim 9, wherein said drainage tank is constructed of plastic and said metering tank is constructed of stainless steel.

11. An improved dispensing valve assembly for use with a pressurized container, said valve assembly comprising:

a mounting cup adapted to be secured to a container;

a metering tank secured within said mounting cup, said metering tank comprising an axially extending collar portion in contact with said mounting cup, an axially extending metering tank portion radially spaced apart from said mounting cup and a radially extending annular flange portion having an outer end integral with said collar portion and an inner end integral with said metering tank portion;

a drainage tank assembly comprising a tank portion surrounding said metering tank portion of said metering tank and a sealing structure abutting the metering tank so as to provide a seal between the interior of the tank portion of the drainage tank and the mounting cup; and a plurality of radially spaced ribs extending radially inward from an interior surface of the tank portion of the drainage tank toward an exterior surface of said metering tank portion of said metering tank, the ribs each having a radially innermost surface which is radially spaced from the exterior surface of the metering tank.

12. The dispensing valve assembly of claim 11 wherein the sealing structure of the drainage tank comprises a portion of the drainge tank sealingly abutting the radially extending flange portion of the metering tank.

13. The dispensing valve assembly of claim 11 wherein the sealing structure of the drainage tank comprises an axially extending portion which sealingly abuts the radially extending flange of said metering tank.

14. An improved dispensing valve assembly for use with a pressurized container, said valve assembly comprising:

a mounting cup adapted to be secured to the container;

a metering tank having a band seal mounted thereon secured within said mounting cup, the metering tank comprising an axially extending collar portion in contact with said mounting cup, an axially extending metering tank portion spaced radially apart from said mounting cup and a radially extending annular flange portion having an outer end integral with said collar portion and an inner end integral with said metering tank portion, said axially extending metering tank portion having an interior surface, an outside surface and at least one radially directed opening extending between the interior surface and the outside surface to communicate the interior of the metering tank portion with the exterior of the metering tank portion;

a band seal mounted on the outside surface of the metering tank portion, said band seal resiliently covering each radially directed opening;

a drainage tank assembly, said drainage tank assembly comprising a sealing structure and a tank portion, said sealing structure being in sealing contact with the metering tank, said tank portion being radially spaced from the metering tank and including at least one radially extending internal rib extending radially inward from said tank portion of the drainage tank toward the metering tank so as to limit axial displacement of the band seal such that the band seal remains over the radially directed opening, the integral rib having a radially innermost surface which is radially spaced from the metering tank. directed opening.

15. The dispensing valve assembly of claim 14 wherein said sealing structure sealingly contacts the radially extending annular flange portion of the metering tank so as to provide a seal between the interior of the tank portion of the drainage tank and the mounting cup.

16. The dispensing valve assembly of claim 14 wherein said sealing portion is radially spaced between a portion of the mounting cup and the metering tank portion of the metering tank and extends axially into sealing contact with the radially extending flange portion of the metering tank.

17. The dispensing valve assembly of claim 14 wherein a plurality of radially spaced internal ribs extend radially inward of said drainage tank interior surface.

18. The dispensing valve assembly of claim 17 wherein said plurality of internal ribs are equally spaced about the axis of the drainage tank interior surface.

19. The dispensing valve assembly of claim 14 wherein said at least one internal rib includes a radially innermost surface which is spaced from the outside surface of the metering tank a distance which is less than the radial thickness of the band seal such that said band seal is unable to freely pass between the radially innermost surface of the internal rib and the outside surface of the metering tank.

* * * * *

UNITED STATES PATENT AND TRADEMARK OFFICE

CERTIFICATE OF CORRECTION

PATENT NO. : 4,867,352

DATED : 19 September 1989

INVENTOR(S) : Philip MESHBERG

It is certified that error appears in the above-identified patent and that said Letters Patent is hereby corrected as shown below:

| Column | Line | |
|---|---|---|
| 1 | 62 | Change "press re" to --pressure--. |
| 2 | 35 | Change "tan" to --tank--. |
| 3 | 6 | Change "an" to --and--. |
| 7 | 12 | Change "interval" to --internal--. |
| 9 | 3 | After "tank." delete "directed opening". |

Signed and Sealed this

Sixteenth Day of October, 1990

*Attest:*

HARRY F. MANBECK, JR.

*Attesting Officer*

*Commissioner of Patents and Trademarks*